United States Patent [19]

Suga

[11] 4,005,325

[45] Jan. 25, 1977

[54] CARBON ELECTRODE FOR EMITTING LIGHT SIMILAR TO SUNSHINE FOR LIGHT-FASTNESS TESTING

[76] Inventor: Shigeru Suga, Yoyogi 5-20:2, Shibuya, Tokyo, Japan

[22] Filed: July 22, 1975

[21] Appl. No.: 598,076

[52] U.S. Cl. ..... 313/352; 13/18; 314/60; 313/311; 313/354; 313/355

[51] Int. Cl.[2] ..... H01J 1/02; H01J 1/14; H01J 1/38; H01J 1/48

[58] Field of Search ..... 313/352, 354, 357, 353, 313/355, 356, 311; 314/15, 16, 18; 13/15, 16, 18

[56] References Cited

UNITED STATES PATENTS

| | | | |
|---|---|---|---|
| 2,185,679 | 1/1940 | Parisot | 313/354 X |
| 3,262,005 | 7/1966 | Riek | 313/352 X |
| 3,297,903 | 1/1967 | Riek | 313/357 X |
| 3,313,976 | 4/1967 | Lauzau et al. | 313/357 X |
| 3,399,322 | 8/1968 | Ambe | 313/352 X |

FOREIGN PATENTS OR APPLICATIONS

| | | | |
|---|---|---|---|
| 622,748 | 5/1946 | United Kingdom | 313/357 |

*Primary Examiner*—Saxfield Chatmon, Jr.
*Attorney, Agent, or Firm*—Wenderoth, Lind & Ponack

[57] ABSTRACT

A carbon electrode for a carbon arc lamp for emitting light similar to sunshine for use as a light source in light-fastness and weathering tests. The carbon electrode is composed of carbon which is homogeneously mixed with an amount of an incandescent material in a proportion of 6 to 12 weight percent of the total weight of the carbon and incandescent material together, and then molded into the shape of the electrode. The surface of the carbon electrode, exclusive of the top thereof, is provided with a copper or other metal coating.

3 Claims, 16 Drawing Figures

CARBON ELECTRODE FOR EMITTING LIGHT SIMILAR TO SUNSHINE FOR LIGHT-FASTNESS TESTING

This invention relates to electrodes for carbon arc lamps, and more particularly to electrodes for such lamps which can be used in light-fastness and weathering test apparatus and which emit light similar to sunlight.

BACKGROUND OF THE INVENTION AND PRIOR ART

A carbon arc lamp is often used as a light source in weathering and light-fastness tests. Both upper and lower conventional carbon electrodes, for example, those used in tests according to Japanese Industrial Standards (JIS) or the International Organization for Standardization (ISO) (in TC 61: Plastic) have had a core structure. The upper carbon electrode has had a large diameter, for example 23mm and the lower electrode has had a small diameter, 13mm for example. Both carbon electrodes are held in suitable holders and are automatically ignited by a system having a stabilized power source, a detector circuit for detecting the discharge current, and a servo mechanism for automatically adjusting the electrodes to compensate for loss of electrode material, so that light is continuously emitted.

FIGS. 1 and 2 show the structure of a conventional upper carbon electrode described above and FIGS. 3 and 4 show the structure of alower carbon electrode. Both the upper and lower electrodes have a lower structures except for the diameters. A core is provided in the electrodes and has a cross section in a shape similar to a gear, and is an incandescent material. The material around the core is mainly carbon for combustion during discharge of the lamp and contains no incandescent material. The outer surface of the electrode is covered with a copper metal coating, exclusive of the top of the electrode. When current is discharged between two of these electrodes an arc occurs as shown in FIGS. 9 and 10. In FIG. 9 the discharge is shown as taking place between the cores of the incandescent material and in FIG. 10 the discharge is shown as taking place between the portion of the electrodes containing no incandescent material, i.e. the portions radially outwardly of the core. When a continuous discharge takes place, if the discharge is started from core to core, as seen in FIG. 9, the incandescent material contained in the core is consumed gradually as combustion occurs, and a depression is formed in the ends of the electrodes. Then the arc moves and occurs between the carbon portions surrounding the cores and further moves to the outer sides of the electrodes, as seen in FIG. 10. As the outer carbon portions are then consumed, the discharge again returns to the core-to-core discharge position. Such moving of the discharge position is irregular and the discharge voltage and current vary with this moving. Accordingly, the intensity of light changes as the wattage equal to the voltage times the current changes. FIG. 15 shows an example of such a variation of the voltage and current over the course of time.

If the light emitted by this arc is measured using a spectrophotometer for obtaining a spectral composition, continuous curves containing the photoemission spectra of the two types of discharge, are obtained as seen in FIGS. 13 and 14. The spectra of the incandescent material, such as a cerium compound, for example, is as shown in FIG. 13 for the core-to-core discharge. This light contains a large amount of visible light components. In contrast to this, the spectrum of the light from discharge between the outer portions, as shown in FIG. 14, contains only a small amount of visible light components, mainly a cyan band spectrum due to photoemission of the carbon and the nitrogen gas in the atmosphere.

Because light-fastness and weathering test apparatus is used for artificially causing deterioration of material with irradiation which is similar to sunshine in a natural environment, the spectral composition of the light used for this irradiation must be the same as or similar to sunshine, having ultraviolet and visible light components. It is therefore desirable that the light emitted from the carbon electrodes have a spectral composition approximating the sunshine, as shown in FIG. 13, and further that a stable light intensity be provided.

OBJECTS AND BRIEF SUMMARY OF THE INVENTION

An object of this invention is to provide a carbon electrode for emitting light with a spectrum similar to sunshine and which produces an extremely stable discharge with respect to both the spectral composition and intensity of the light emitted from the discharge arc.

These objects are achieved according to the invention by a carbon electrode in which carbon is homogeneously mixed with an amount of an incandescent material in a proportion of 6 to 12 weight percent of the total weight of both said carbon and said incandescent material, and the mixture is molded into the desired electrode shape. A copper metal coating is provided over the electrode, exclusive of the top of the electrode. No core is present in the electrode. Thus, light can be obtained which is extremely stable in both its spectral composition and its intensity during continuous discharge by the photoemission from the incandescent material which is present throughout the electrode despite any variation in the position of the discharge arc between the electrodes of the present invention.

BRIEF DESCRIPTION OF THE DRAWINGS

The invention will now be described in connection with the accompanying drawings, in which.

DETAILED DESCRIPTION OF THE INVENTION

Figure 1:
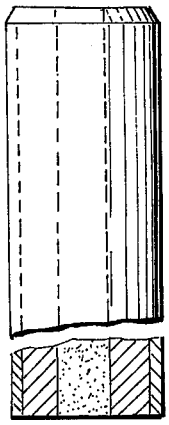
FIG. 1 is a sectional elevation view of a prior art carbon electrode for producing light simulating sunshine used in the upper section of a conventional arc lamp.
Figure 3:
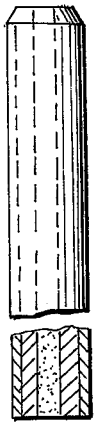
FIG. 3 is a sectional elevation view of a prior art carbon electrode similar to that of FIG. 1, used in the lower section of a conventional arc lamp.
Figure 5:
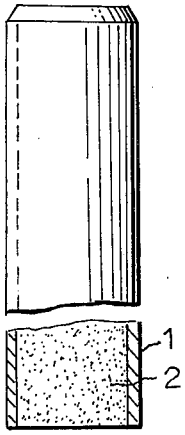
FIG. 5 is a sectional elevation view of a carbon electrode similar to that of FIG. 1 but according to this invention.
Figure 7:
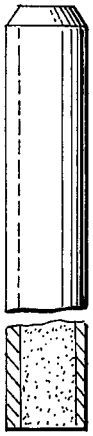
FIG. 7 is a sectional elevation view of a carbon electrode similar to that of FIG. 3 but according to this invention.
Figure 2:
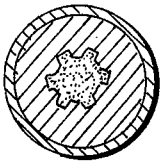
FIG. 2 is a transverse sectional view of the carbon electrode of FIG. 1.
Figure 4:
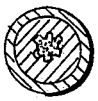
FIG. 4 is a transverse sectional view of the carbon electrode of FIG. 3.
Figure 6:
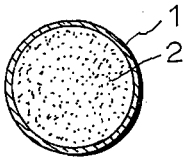
FIG. 6 is a transverse sectional view of the carbon electrode of FIG. 5.
Figure 8:
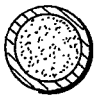
FIG. 8 is a transverse sectional view of the carbon electrode of FIG. 5.
Figure 9:
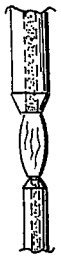
FIG. 9 is an elevation view showing the arc between the cores of conventional carbon electrodes of FIGS. 1–4.
Figure 10:
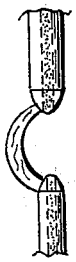
FIG. 10 is an elevation view showing the arc between the outer sections of the conventional carbon electrodes of FIGS. 1–4.

Referring to FIGS. 5 through 8, these show the structure of carbon electrodes according to this invention, FIGS. 5 and 6 showing an upper carbon electrode and FIGS. 7 and 8 showing a lower carbon electrode. The structure of the upper and lower carbons is identical, except for their diameters. A copper or other metal coating 1 is provided on the outside of a carbon material 2 which is composed of carbon for combustion and an incandescent material. The carbon is homogeneously mixed with said incandescent material and molded to the desired shape. The incandescent material is present in a proportion of 6 to 12 weight percent of the total weight of both said carbon and said incandescent material. In these figures, the dotted portions show the mixture including the incandescent material. The carbon for combustion can be carbon black, graphite, or amorphous carbon, for example, and the incandescent material can be cerium fluoride, for example. Furthermore, a trace of stabilizer can be included, if necessary.

Figure 11:
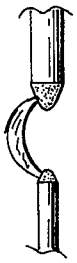
FIG. 11 is an elevation view showing the arc between the outer portions of the carbon electrodes according to this invention.
Figure 12:
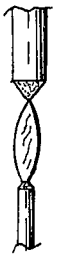
FIG. 12 is an elevation view showing the arc between the tips of the carbon electrodes according to this invention.
Figure 13:
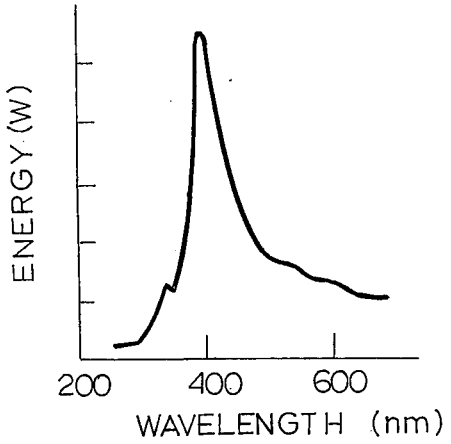
FIG. 13 is a graph of the light spectrum of a luminescent material used in conventional carbon electrodes.
Figure 14:
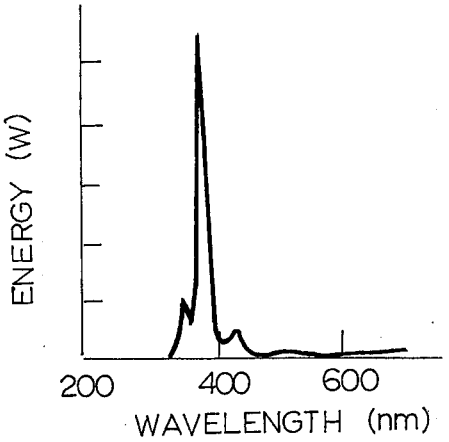
FIG. 14 is a graph of the light spectrum of the arc between the outer sections of the conventional carbon electrodes.
Figure 15:
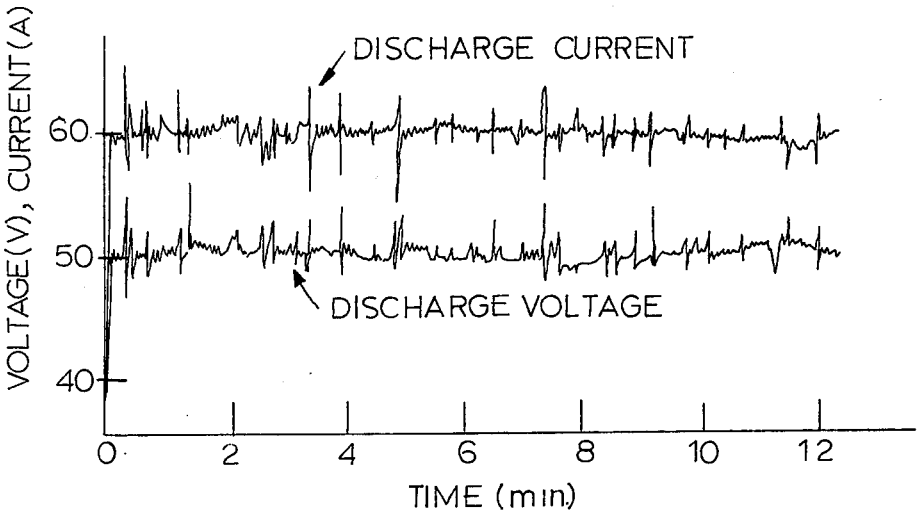
FIG. 15 is a graph of current-voltage variation during discharge of an arc between the conventional carbon electrodes.

If a carbon electrode made as described above is ignited and the spectral composition is observed, the light is always found to include light from the incandescent material, even if the arc moves to any point on the electrodes, as shown in FIGS. 11 and 12, and light with an extremely stable spectral composition is obtained.

Figure 16:
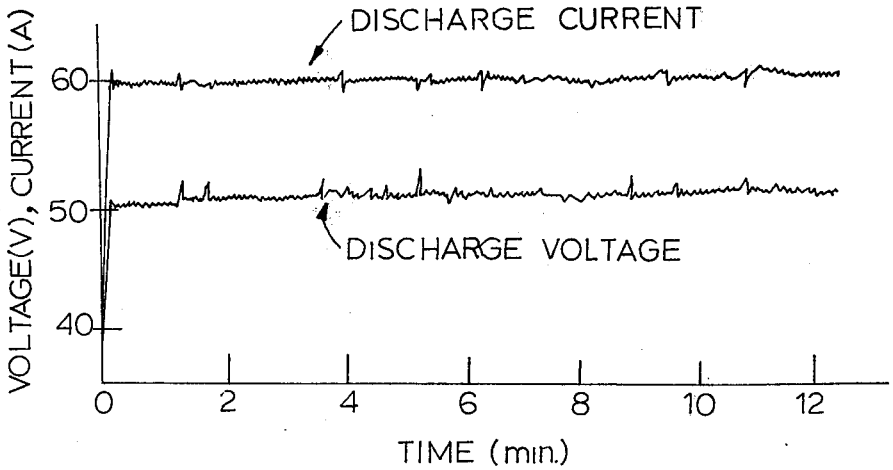
FIG. 16 is a graph of current-voltage variation during discharge of an arc between carbon electrodes according to this invention.

The variation in intensity of this light is also extremely small, as shown in FIG. 16, being less than half that of the prior art carbon electrodes of FIG. 1–4.

Because a stable light is obtained, a reduction of 10% in the amount of carbon consumed is achieved in comparison with the prior art electrodes.

What is claimed is:

1. A carbon electrode assembly for a carbon arc lamp used for simulating sunlight in light-fastness and weathering testors, said assembly comprising:

a first elongated upper electrode element fitted at one end into said arc lamp;

an elongated second lower electrode element fitted at one end into said arc lamp, the free end thereof being opposite the free end of said first electrode and spaced therefrom;

one of said first and second electrodes being smaller in diameter than the other electrode; and said upper and lower electrodes each being comprised of a homogeneous mixture of carbon and an incandescent material, said incandescent material being present in an amount from 6 to 12 percent by weight of the total weight of the carbon and incandescent material, and a copper metal coating surrounding the outside of said electrodes other than at the end thereof which is spaced from and opposite the other electrode.

2. A carbon electrode as claimed in claim 1 in which the carbon is taken from the group consisting of carbon black, graphite and amorphous carbon.

3. A carbon electrode as claimed in claim 1 in which the incandescent material is cerium fluoride.

* * * * *